United States Patent [19]

Pinto et al.

[11] Patent Number: 4,843,684

[45] Date of Patent: Jul. 4, 1989

[54] TEXTILE FIBER FEEDING AND CLEANING SYSTEM AND METHOD

[75] Inventors: Akiva Pinto, Gastonia, N.C.; Guenther Lucassen, Haltern; Werner Frosch, Schwanewede, both of Fed. Rep. of Germany

[73] Assignee: Hergeth Hollingsworth GmbH, Duelman, Fed. Rep. of Germany

[21] Appl. No.: 20,623

[22] Filed: Feb. 27, 1987

[51] Int. Cl.[4] ..... D01B 3/04; D01B 3/00; D01G 15/40

[52] U.S. Cl. ..... 19/65 A; 19/105; 19/204

[58] Field of Search ..... 19/105, 65 A, 200, 202, 19/205, 204, 65, 105

[56] References Cited

U.S. PATENT DOCUMENTS 4,476,611 10/1984 Keller et al. ..... 19/105

4,682,388 7/1987 Pinto ..... 19/105

*Primary Examiner*—Louis K. Rimrodt

*Attorney, Agent, or Firm*—Cort Flint

[57] ABSTRACT

A system and method for cleaning and feeding textile fibers is disclosed wherein supply units (A) include a cleaning machine (B) fed by a batt forming machine (C) which includes a reserve chute (42) and a formation chute (44). The reserve chute and formation chute are partitioned whereby a serial flow of fiber laden air may be utilized to deliver fibers to a number of the supply units connected in series. Each supply unit (C) may feed a parallel line (10, 12, 14) of card machines (16). Each card machine (16) is fed by a vertical chute feed (18) to which a fiber delivery air flow is delivered from supply units (60, 62, 64). In this manner, a first fiber batt of uniform density across its width is fed to the cleaning machines. The fibers are more uniformly fed and separated to provide more uniform opening and cleaning of the fibers. The individual and cleaned fibers are fed to a vertical chute feed wherein a second fiber batt is formed for feeding to the textile cards.

14 Claims, 2 Drawing Sheets

TEXTILE FIBER FEEDING AND CLEANING SYSTEM AND METHOD

BACKGROUND OF THE INVENTION

The invention relates to a system and method of cleaning and feeding textile fibers to a system of card machines. Particularly, the invention relates to the feeding of cleaned fibers to a plurality of distribution lines having a series of textile cards. Each distribution line is supplied by a supply unit which includes a cleaning machine fed by a fiber batt forming machine for more uniform fiber opening and cleaning. The batt forming machine includes a partitioned reserve chute which facilitates serial connection of more than one supply unit along a fiber delivery line. Multiple supply units may be fed from a single delivery line which then distribute fibers to parallel lines of textile card machines.

Heretofore, textile fiber cleaning machines have typically been fed by depositing fibers loosly in a column in a drop box above the cleaning machine. The fibers are subsequently fed to the opening roll of the cleaning machine by delivery rolls. The fibers are accumulated above the delivery rolls in the form of a loose mat. The density of fibers varies in the loose mat across the axial length of the feed rolls. Light and heavy fiber areas occur in the loose mat along the axis of the feed rolls. The light areas tend to be overworked which contributes to fiber damage. The heavy areas are given less working and cleaning. Non-uniform cleaning of the fibers results. To compensate for the light and heavy areas and the loose fiber mat, segmented pedal feed plates have been utilized in cleaning machines. The segmented pedals of the feed plate allow the thick and thin areas to be fed to the opening load without jerk ends of the thin loads as may occur in the case of a single feed plate. However, this operation is not always reliable and fiber damage and ununiform cleaning result.

It is also known to utilize a laminar chute to feed fibers to a cleaning machine by a fan. The transport air brings the fiber tufts from a preceeding machine into the vertical laminar chute and compresses the fiber in the chute. The air then escapes through the laminar back wall of the chute. While this type of a chute arrangement may be suitable for feeding of fibers to a single cleaning machine, it does not allow for delivery of fibers to multiple cleaning machines in series. The air flow that delivers the fibers is used for delivery and for compression of the fibers. The delivery air may not be utilized to deliver fibers to subsequent serial machines. This is needed in many installations where a large number of card machines and cleaning machines may be fed by common fiber sources. Heretofore, costly auxiliary duct work, diverting valves, and condensors have been employed to deliver fiber laden air to more than one machine.

Accordingly, an important object of the present invention is to provide a method and system for feeding and cleaning fibers in which a bat forming device feeds a fiber batt having a uniform density to a cleaning machine so that a consistent, low weight of fibers is fed to the cleaning machine along the axis rotation of the opening roll for more uniform opening and cleaning of fibers.

Still another object of the invention is to provide a method and system for cleaning and feeding fibers which includes a supply unit having a fiber batt forming machine which feeds a batt to a cleaning machine wherein serial fiber delivery air may be directed through multiple supply units.

Another object of the invention is to provide a system and method for feeding cleaned fibers in which a number of parallel textile card lines may be fed from individual cleaning machines connected in series without the use of costly condensors and diverting valves.

SUMMARY OF THE INVENTION

The above objectives are accomplished according to the present invention by feeding a cleaning machine with a fiber batt forming device which includes an upper reserve chute and a lower batt forming chute separated by a partition. At least one fiber source is connected in series to the separated reserve chutes of a number of batt forming devices feeding and cleaning machines. A fiber batt formed in the formation chute is discharged by delivery rolls directly to the cleaning machine which separates and individualizes the fibers from the fiber batt and opens the fibers for further cleaning. The individual cleaned fibers are then conveyed pneumatically along a distribution line to a series of vertical chute feeds each of which forms a second fiber batt and feeds it to an associated card. In this manner, parallel lines of carding machines may be fed individually from separate cleaning machines each of which is connected in series to the source of fibers. Each cleaning machine is fed a fiber batt for more uniform cleaning. According to the method, fibers prepared by opening and cleaning are stored in a fiber reserve chute and are then formed into a first densified fiber batt. The first fiber batt is fed to a cleaning machine which removes the individual fibers from the fiber batt for further opening and cleaning. The further opened and cleaned fibers are then delivered to a vertical chute feed of an associated card in which the fibers are further compacted into a second densified fiber batt fed to the card.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
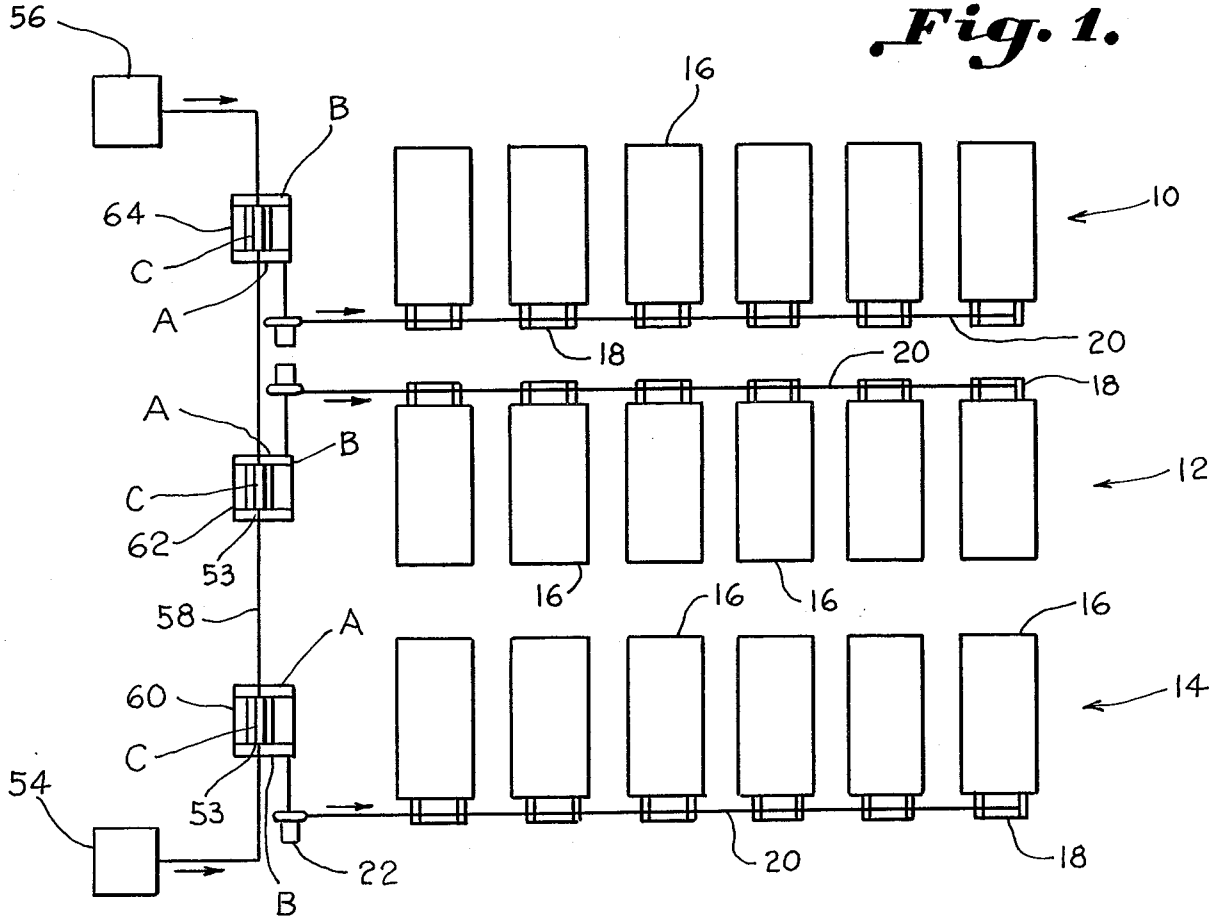
FIG. 1 is a floor diagram of a system and method for cleaning and feeding fibers in accordance with the present invention.

Referring now in more detail to the drawings, a floor plan is illustrated wherein a number of parallel distribution lines, designated generally as 10, 12, and 14, feed textile cards 16. Each line includes a plurality of textile cards 16 arranged in series. Each of the cards 16 is fed by a vertical chute feed 18 which may be a conventional vertical chute feed having a reserve chute and a fiber batt formation chute such as disclosed in U.S. Pat. No. 4,476,611. Each of the vertical chute feeds 18 in each card line is fed by a fiber delivery duct 20 carrying fiber-laden air produced by a blower fan 22. Blower fan 22 may be any suitable blower such as a model TV 300 manufactured by Hergeth Hollingsworth GmbH of Duelman, Germany. The ducting and pneumatic conveyance of fibers to vertical chute feeds is conventional.

The suction side of each blower 22 is connected to supply unit A which includes a fiber cleaning machine B which is fed a fiber batt from a batt forming machine C. In practice, cleaning machine B may be any suitable cleaning machine such as a model VO pre-opener, and batt forming machine C may be a vertical chute feed such as a Masterchute MC-N, both of which are manufactured by Hergeth Hollingsworth GmbH.

Figure 2:
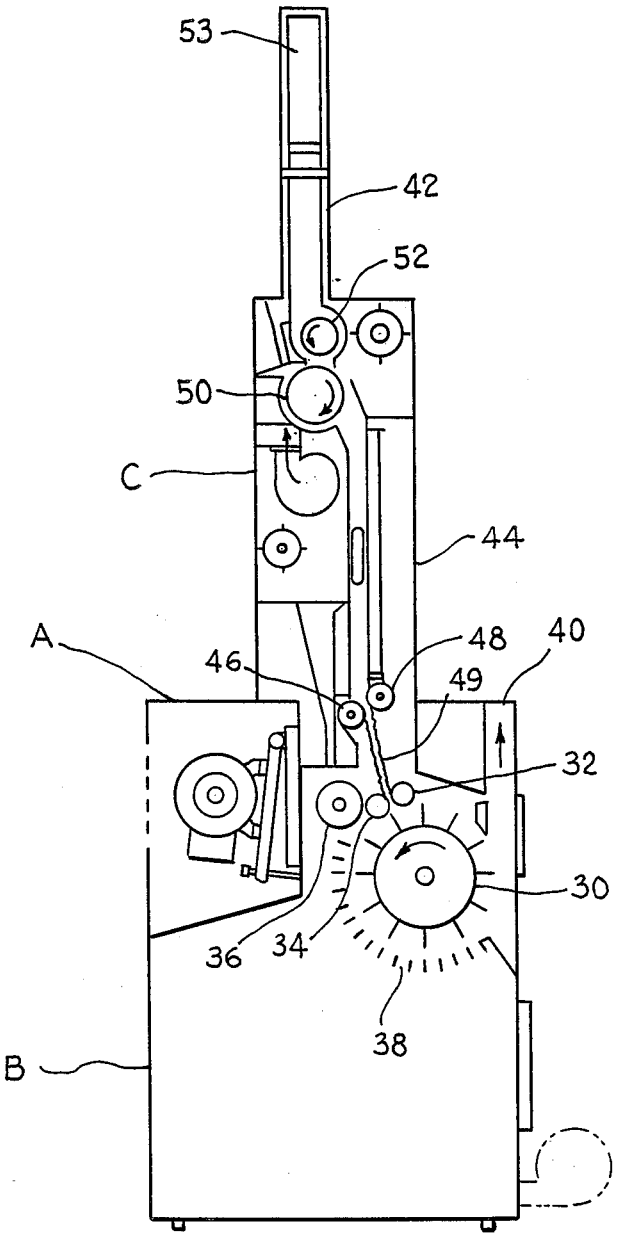
FIG. 2 is a schematic diagram of a supply unit which includes a cleaning machine fed by a fiber batt forming machine in accordance with the present invention.

Referring now in more detail to FIG. 2, it can be seen that cleaning machine B includes a fiber opening roll 30 which is fed fibers by two feed rolls 32 and 34 which may be conventional fluted feed rolls. A star roll 36 assists in transporting of fibers to the opening roll 30. Waste from the opened fibers falls through lattice openings 38 and may be removed manually or automatically in a conventional manner. The cleaned fibers leave the machine through an outlet 40 and connect to blowers 22. Batt forming device C typically includes a reserve section or chute 42 and a batt forming section or chute 44. The batt forming chute includes a pair of lower delivery rolls 46 and 48 which discharge a first densified fiber batt 49 to feed rolls 32 and 34 of cleaning machine B. Formation chute 44 compacts fibers by means of an oscillating plate 48 in a manner. Air from a blower 50 assists in the compression of fibers to further densify the fibers in the batt formed by the oscillating plate 51. The highly densified fiber batt has a uniform density across the axis of rotation of feed rolls 32 and 36 when discharged to cleaning machine B. In the upper portion of batt forming chute 44 is an opening roll 50 and a top feed roll 52. Fibers are delivered to a top duct inlet section 53 of reserve chute 42 by a fiber laden airflow from either a fiber source 54 or 56, as can best be seen in FIG. 1. The fibers are deposited out of the airflow into reserve chute 42 and are fed by top feed roll 52 to opening roll 50 and into batt formation chute 44. The upper portion of batt forming chute 44 housing top feed roll 52 and opening roll 50 serves to effectively partition reserve chute 42 such that the airflow delivering fibers is separated from air produced by fan 50 for compressing fibers in formation chute 44 which serves as a batt forming means. The above description of batt forming device C and its operation are conventional and are disclosed in the aforementioned U.S. Pat. No. 4,476,611, the teachings of which are hereby incorporated by reference.

A continuous flow of fiber deliver air through the top duct section of reserve chute 42 may be had which facilitates serial fiber delivery to a number of supply units A, as can best be seen in FIG. 1. For this purpose, a first duct line 58 is connected to fiber sources 56 and 54 and in series through supply units 60, 62, and 64. In operation, sources 56 and 54 may be two different sources of fibers. For example, source 54 may be mixed one hundred percent (100%) synthetic or cotton fibers. Source 56 may be blended fibers of cotton and synthetics or other blends. Card lines 10, 12, and 14, may be fed from either source. Alternately, source 56 may feed line 10 while source 54 feeds lines 12 or 14 or source 54 may feed line 14 while source 56 feeds line 10 or 12. Any number of supply units may be utilized in series and any number of cards may be included in a series in a card line. Of course, more than two sources of different type fibers may also be utilized with different numbers and combinations of supply units and card lines. Sources 56 and 54 may be any combination of conventional fiber opening, blending, and mixing equipment which prepares the fibers in varying degrees of opening and cleaning the fibers, blending the fibers in desired ratios, or mixing the fibers in preparation for feeding to supply units A. Duct 58 may be closed off by conventional means at any supply unit 60, 62, or 64 to allow delivery of fibers from sources 54 or 56 in opposing directions.

In accordance with the method, prepared fibers which have been prepared by trash removal and other early stages of opening and cleaning are stored in a fiber reserve chute and fed to a formation chute for formation of a first densified fiber batt. The first fiber batt is subjected to cleaning which separates the fibers from the first fiber batt into smaller fiber tufts for further fine opening and cleaning. The individual fiber tufts are opened and cleaned and thereafter formed into a second compacted fiber batt for feeding to a textile card. In a preferred embodiment, the prepared fibers are conveyed to a series of reserve chutes which feed individual batt forming devices which form and feed densified fiber batts to individual cleaning machines. The cleaning machines feed a series of textile cards.

While a preferred embodiment of the invention has been described using specific terms, such description is for illustrative purposes only, and it is to be understood that changes and variations may be made without departing from the spirit or scope of the following claims.

What is claimed is:

1. A textile fiber feeding and cleaning system for feeding cleaned fibers to a textile card comprising the combination of:

a source of fibers;

a fiber delivery means connected to said source of fibers;

a fiber supply unit which includes a fiber batt forming machine and a fiber cleaning machine which cleans fibers fed in a batt from said batt forming machine;

said fiber batt forming device having a upper reserve section and a lower fiber batt forming section;

said upper reserve section being connected to said fiber delivery means;

a top feed roll carried adjacent an upper portion of said batt forming section, and a top opening roll carried adjacent said top feed roll for opening fibers fed by said top feed roll into said batt forming section;

batt forming means carried in said batt forming section for compacting said fibers into a highly densified fiber batt;

a pair of lower delivery rolls for delivering said densified fiber batt from said batt forming section;

said fiber cleaning machine arranged adjacent and below said batt forming section for receiving said densified fiber batt;

said fiber cleaning machine having a fiber batt feed means for receiving and feeding said fiber batt;

a fiber opening roll carried in said fiber cleaning machine adjacent said batt fiber feed means;

said fiber batt feed means feeding said densified fiber batt to said fiber opening roll which separates said fibers from said densified fiber batt and opens and cleans said individual fibers; and fiber distribution means connected to said fiber cleaning machine for distributing said cleaned fibers to said textile card.

2. The system of claim 1 including:
a plurality of said textile cards;
a vertical chute feed connected to each said textile card having a batt forming means for feeding a second densified fiber batt to said textile card; and
duct means connecting said fiber distribution means serially to each of said vertical chute feeds for feeding said vertical chute feeds in series from said fiber cleaning machine.

3. The device of claim 1 including:
a number of said fiber supply units arranged in series; and
a first duct connecting said reserve sections of said fiber batt forming devices of respective supply units in series so that said fibers are delivered in a continuous manner through said reserve section.

4. The device of claim 3 wherein each supply unit is connected in series with a plurality of textile cards each having a vertical chute feed for feeding a compacted fiber batt to said textile card, and a second duct serially connecting said vertical chute feeds in series with the fiber cleaning machine of said supply units.

5. The device of claim 1 wherein said fiber feed means comprises a pair of feed rollers carried adjacent an upper portion of said fiber cleaning and opening chamber.

6. A textile fiber cleaning and feeding system comprising:
a source of fibers;
a fiber delivery means connected to said source of fibers;
a plurality of supply units including a fiber batt forming machine having a reserve section connected in series to said fiber delivery means and a batt forming section disposed below said reserve section for receiving fibers from said reserve section and compacting said fibers into a first highly densified fiber batt;
first duct means serially connecting said reserve sections of said batt forming machines to said source of fibers;
said supply unit including a fiber cleaning machine arranged below said batt forming machine for receiving said first densified fiber batt from said batt forming machine;
said fiber cleaning machine having a fiber opening roll and a fiber batt feed for feeding said first fiber batt to said fiber opening roll which separates said fibers from said first fiber batt and opens and cleans said fibers;
a plurality of vertical chute feeds and a second duct means serially connecting said chute feeds to each of said fiber cleaning machines;
a textile card machine connected to each of said vertical chute feeds; and
said vertical chute feed having a batt forming means for compacting said cleaned fibers into a second densified fiber batt which is fed to said textile card.

7. The system of claim 6 wherein each of said batt forming machines comprises a top feed roll carried between said reserve section and batt forming section and a top opening roll carried adjacent said top feed roll for opening fibers fed by said top feed roll and into said batt forming section; and said reserve section and batt forming section being separated by said top feed roll and top opening roll in such a manner that air may be delivered through said reserve section for feeding said reserve sections in series.

8. The device of claim 7 wherein said fiber batt feed means comprises a pair of feed rollers carried adjacent an upper portion of said fiber cleaning machine.

9. A method of cleaning and feeding textile fibers to a plurality of textile cards comprising:
providing a source of prepared fibers;
storing said fibers in a fiber reserve chute;
forming a first densified fiber batt from said stored fibers;
feeding said first fiber batt to a fiber cleaning machine;
separating said fibers from said first fiber batt as small individual fiber tufts;
opening and cleaning said separated fibers as individual fiber tufts;
delivering said cleaned fibers to a vertical chute feed;
forming a second densified fiber batt in said vertical chute feeds; and
feeding said second fiber batt to said textile card for processing.

10. The method of claim 9 including:
delivering a serial air flow of said prepared fibers to a plurality of fiber reserve chutes connected in series with one another and storing said prepared fibers in said reserve chutes;
forming a fiber batt from the fiber stored in each of said reserve chutes;
opening and cleaning fibers from each of said fiber batts in individual cleaning machines; and
delivering the cleaned fibers from each of said fiber cleaning machines to a series of vertical chute feeds each of which feeds a second fiber batt to an associated textile card.

11. The method of claim 10 including:
closing off the feeding of fibers from said source of prepared fibers to said reserve chutes at selective ones of said reserve chutes so that the feeding of fibers may occur by transport air along the same series delivery line but in opposing directions.

12. The method of claim 9 including:
feeding and opening the stored fibers prior to forming said first fiber batt.

13. The method of claim 9 including feeding the stored fibers by means of a fiber feed roll to a fiber opening roll and opening said fibers prior to forming said first fiber batt.

14. A method of feeding textile fibers for cleaning in a cleaning machine and for subsequent processing comprising:
delivering said fibers into a reserve chute;
storing said fibers in said reserve chute above a partition;
feeding said stored fibers to a feed roll which opens said fibers;
feeding said opened fibers into a fiber batt formation chute below said partition and compacting said fibers into a highly densified fiber batt;
feeding said fiber batt to said cleaning machine and opening and cleaning said fibers in said cleaning machine;
delivering said fibers by transport air to a second fiber batt formation chute;
forming a second densified fiber batt; and
delivering said second fiber batt to a textile card for processing.

* * * * *